US006000270A

United States Patent [19]

Mullen

[11] Patent Number: 6,000,270

[45] Date of Patent: Dec. 14, 1999

[54] COLLIMATOR HAVING TAPERED EDGES AND METHOD OF MAKING THE SAME

[75] Inventor: Stephen J. Mullen, Beverly, Mass.

[73] Assignee: SJM Engineering, Inc., Beverly, Mass.

[21] Appl. No.: 09/285,841

[22] Filed: Apr. 2, 1999

Related U.S. Application Data

[62] Division of application No. 08/868,464, Jun. 3, 1997.

[51] Int. Cl.[6] ..... B21D 13/02

[52] U.S. Cl. ..... 72/385; 72/414

[58] Field of Search ..... 72/385, 414, 416

[56] References Cited

U.S. PATENT DOCUMENTS

| | | | |
|---|---|---|---|
| 3,430,476 | 3/1969 | Duda | 72/190 |
| 3,936,340 | 2/1976 | Muehllehner | 72/196 |
| 3,943,366 | 3/1976 | Platz et al. | 250/505 |
| 3,971,243 | 7/1976 | Jones | 72/385 |
| 4,008,591 | 2/1977 | Vos et al. | 72/385 |
| 4,081,687 | 3/1978 | York et al. | 250/505 |
| 4,450,706 | 5/1984 | Engelmohr | 72/385 |
| 4,635,462 | 1/1987 | Bald | 72/385 |
| 4,830,723 | 5/1989 | Galvagni et al. | 204/192.17 |
| 5,223,108 | 6/1993 | Hurwitt | 204/192.12 |
| 5,302,218 | 4/1994 | Shirai et al. | 148/695 |
| 5,330,628 | 7/1994 | Demaray et al. | 204/192.12 |
| 5,544,771 | 8/1996 | Lee et al. | 216/2 |

*Primary Examiner*—David Jones
*Attorney, Agent, or Firm*—Kenway & Crowley

[57] ABSTRACT

A method of making a collimator having a generally honeycomb shape made from sheets of thin metal. The sheets are deformed using a progressive form die assembly into what may be termed truncated pyramids alternately inverted with top and bottom major flats connected by slant walls. Successive sheets are joined together by displacing them relative to each other so that the top major flats of the truncated pyramids of one sheet contact the bottom major flats of the succeeding sheet. Advantageously, the edges of the sheet are tapered to a pointed edge by the progressive form die assembly, which may also form roughened surfaces on the sheets by swedging. Edges of the slant walls which connect top and bottom major flats of the truncated pyramid shape are provided with a dual taper, and the edges of the major flats are provided with a single taper. When successive sheets are joined, the top and bottom major flats of successive sheets form a dual tapered edge from the single tapered edges on the flats of each sheet. Thus, the completed collimator has leading edges, all of which are tapered to a pointed edge. As a result, the rate of growth of metallic particles beyond the borders of the collimator cell walls is decreased compared to prior art designs having flat edges. The useful life of the collimator is, therefore, drastically increased, and the production downtime for the manufacturing process is reduced.

3 Claims, 5 Drawing Sheets

COLLIMATOR HAVING TAPERED EDGES AND METHOD OF MAKING THE SAME

This application is a divisional of U.S. Ser. No. 08/868,464 filed Jun. 3, 1997.

FIELD OF THE INVENTION

The present invention relates in general to collimators which are used in the manufacture of semiconductor devices, and in particular to a collimator having tapered leading edges which increase the useful life of the collimator relative to those of the prior art.

BACKGROUND OF THE INVENTION

In the manufacture of semiconductor devices, it is the practice to form uniform thin films of metallic material, usually aluminum or titanium, by deposition on the surface of a silicon semiconductor wafer. The metallic material is deposited on the surface of the wafer and extends downward into etchings or channels formed in the wafer to create electrical connection between various points. Precise control of the process of depositing the metallic films is critical to the operation and quality of the semiconductor device being fabricated. If the metallic layer is deposited insufficiently, or is deposited with contaminants that affect the integrity of the intended electrical connections, then the semiconductor is considered unreliable and, therefore, defective. The losses of production when the metallic layer is not deposited accurately and efficiently are a part of the cost of manufacturing the semiconductor devices, and thus the cost of the devices to consumers increases dramatically.

To produce semiconductor devices on an efficient scale, the industry has used sputtering or Physical Vapor Deposition (PVD) processes. PVD equipment generally includes a source of metallic material which is vaporized in a vacuum. The vaporized metallic particles are forced towards the semiconductor wafer to form the metallic layer thereon.

It has been recognized, however, that the metallic particles formed in the PVD process impact on the wafer at varying angles of incidence. As a result, the metallic layer in the areas of the etchings in the wafer is formed unevenly, leaving a relatively thick lateral layer on the side walls of the etchings and a thin layer at the bottom of the etchings. In fact, the lateral growth on the side walls can be deposited in a manner which occludes the opening of the etching, thereby preventing proper formation of the metallic layer at the bottom of the etching. Occlusion of the opening of the etching also affects later steps in the process involving the deposition of a dielectric material over the wafer.

To prevent these disadvantages, the industry has begun to incorporate collimators into sputtering and PVD equipment. The collimator is typically a metallic structure having a plurality of cells/openings which is positioned between the source of metallic material and the wafer to act as a filter. As metallic particles travel toward the wafer, the particles which are not substantially perpendicular to the wafer impact on the cell walls of the collimator and adhere thereto. Thus, the collimator allows only the metallic particles which follow a substantially perpendicular path to the wafer to pass through. The metallic layer which then forms on the wafer is, therefore, of a generally uniform thickness, and the difficulties associated with lateral growth of the film on the etching sidewalls are eliminated.

Examples of PVD systems, sometimes called "sputtering" systems, and collimator structures for use in those systems are disclosed in U.S. Pat. Nos. 5,330,628 and 5,544,771. As shown in these patents, a collimator is typically formed as a honeycomb structure. The cells of the honeycomb structure may be provided with roughened surfaces to improve the ability of the collimator to capture the metallic particles. Also, the collimator is usually formed with a specific aspect ratio, i.e. the ratio of cell height to cell diameter. The aspect ratio of the collimator determines it effectiveness in filtering non-perpendicular metallic particles. A collimator having a high aspect ratio is more effective in filtering the particles than one with a low aspect ratio. A tradeoff exists, however, since the throughput of the PVD equipment is seriously affected by increasing the aspect ratio of the collimator. As the aspect ratio increases, the throughput of the equipment decreases. Accordingly, the aspect ratios of collimators are particularly chosen to achieve a balance between filtering of particles and acceptable throughput.

However, in the course of carrying out the deposition process, the metallic particles which are filtered by the collimator form a layer on the collimator cells which occludes the cell openings. Specifically, mushroom-shaped growths begin to form on the leading edges of the collimator cells thereby reducing the cell input openings and increasing the aspect ratio of the collimator. Ultimately, the throughput of the equipment is reduced so severely that the collimator must be removed and replaced.

Removing the collimator is not easily or quickly done, and it causes significant downtime for the entire manufacturing process. A major delay is caused because when the collimator is replaced, the vacuum in the vacuum chamber is lost and must be re-established. This process can take up to a day to complete. Also, the collimator must be replaced at least once prior to the point at which the source material is replenished. Accordingly, production downtime is encountered-both for replenishing the source material and replacing the collimator.

There is, therefore, a long felt need in the art for a collimator, especially a collimator for use in PVD processes, which has maximum useful life, whereby production downtime associated with the PVD process is minimized.

OBJECTS OF THE INVENTION

Thus, a primary object of the present invention is to reduce the production downtime in vapor deposition processes by providing a collimator having a tapered leading edge which has an extended useful life compared to prior art collimators.

Another object of the present invention is to provide a collimator which improves the efficiency of the manufacturing processes for semiconductor devices, thereby reducing the consumer cost of such devices.

Yet another object of the present invention is to provide a collimator which is of a simple and cost-efficient design.

These and other objects of the present invention will become apparent from a review of the description provided below.

SUMMARY OF THE INVENTION

The present invention is organized about the concept of providing a collimator having tapered leading edges to improve the useful life of the collimator and limit production downtime in the manufacture of semiconductor devices. The collimator of the present invention is preferably formed from sheets of metallic material of a thickness of about 0.015 inches configured in a generally honeycomb shape. The sheets are deformed using a progressive form die assembly into truncated pyramids alternately inverted. Successive sheets are joined together by displacing them relative to each other so that the top major flats of the truncated pyramids of one sheet contact the bottom major flats of the succeeding sheet. The flats are welded together to form the honeycomb structure.

Advantageously, the edges of the sheet are formed with tapered edges by the progressive form die assembly, which may also form roughened surfaces on the sheets by swedging. The slant walls which connect top and bottom major flats of the truncated pyramid shape are provided with dual tapered edges, and the major flats are provided with single tapered edges. When successive sheets are joined, the top and bottom major flats of successive sheets form a dual tapered edge from the single tapered edges on the flats of each sheet. Thus, the completed collimator has leading edges which are all tapered to an edge of about 0.003"0.004" in thickness.

During the PVD process, the rate of growth of metallic particles beyond the borders of the cell walls is decreased compared to prior art designs having flat edges. As a result, the useful life of the collimator is increased drastically, and the production downtime for the manufacturing process is reduced, as is the cost of devices produced.

BRIEF DESCRIPTION OF THE DRAWING

For a better understanding of the present invention, together with other objects, features and advantages, reference should be made to the following description of the preferred embodiment which should be read in conjunction with the following figures wherein like numerals represent like parts.

DETAILED DESCRIPTION OF THE INVENTION

Figure 1:
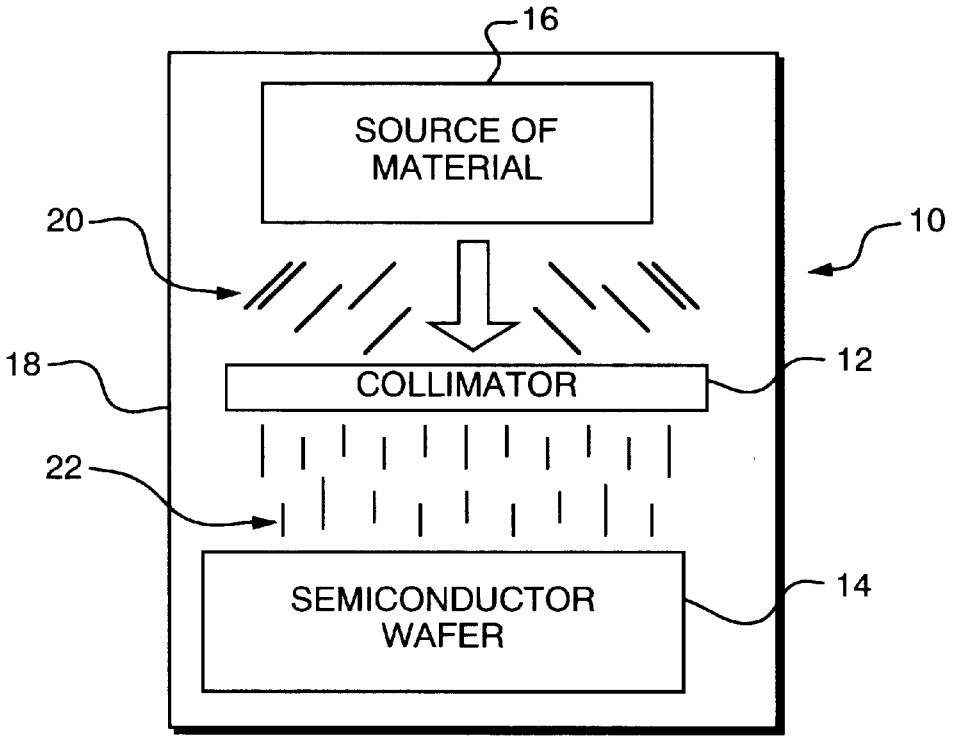
FIG. 1 (PRIOR ART)
FIG. 1: is a block diagram of a typical prior art Physical Vapor Deposition (PVD) device including a collimator.

Referring to FIG. 1 of the drawing, there is shown a block diagram of a portion of a prior art Physical Vapor Deposition (PVD) device 10 including a collimator 12 used in forming a film of metallic material on a semiconductor wafer 14. As shown, the collimator 12 is disposed between a source of depositing material 16 and the semiconductor wafer in a vacuum chamber 18. The source material is vaporized into particles 20 in a manner known in the art, such as that disclosed in the above-cited patents. The function of the collimator is to allow only the particles 22 which follow paths that are relatively perpendicular to the wafer to pass through and to intercept particles that are not relatively perpendicular to the wafer. This ensures that an even layer of metallic material is formed on the wafer surfaces.

Figure 2:
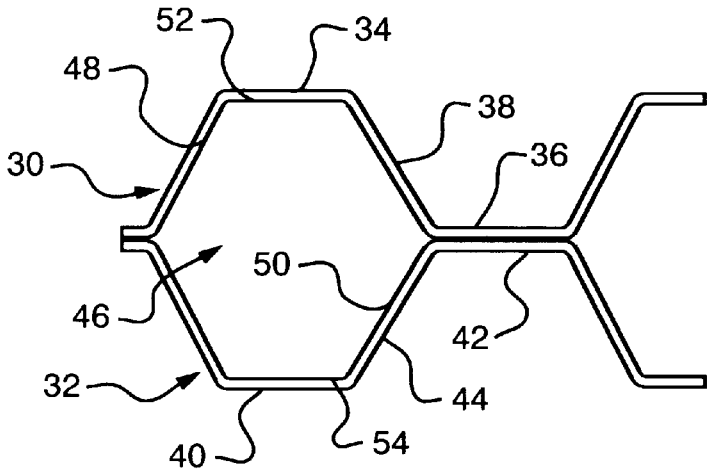
FIG. 2 (PRIOR ART)
FIG. 2: is a top view of a portion of a prior art, honeycomb collimator.

Although many geometric shapes would suffice, prior art collimator designs, as shown for example in FIG. 2, are generally formed into a hexagonal honeycomb shape as here from sheets 30, 32, usually of metal such as steel, aluminum, titanium, stainless steel, or any number of alloys. As shown, a first sheet 30 is formed into corrugations which are shaped into what may be termed repeating truncated pyramids alternately inverted. In each such pyramid, the truncated top major surface or flat 34 is connected to a parallel bottom surface or flat 36 by a slant wall 38. The wall 38 and the flat 34 enclose an angle of approximately 120 degrees. The wall 38 and the flat 36 enclose a similar 120 degree angle.

A second sheet 32 is corrugated identically to the first sheet 30 and includes similar top 42 and bottom 40 major flats and slant wall 44. The sheet 32 is displaced laterally or lengthwise relative to the first sheet 30 by the width of a pyramid base and flats 36 and 42 are welded together or otherwise joined as are similar flats along the length of the sheets.

The hexagonal honeycomb cell 46, which may typically be about ⅝", is defined by the enclosed space between truncated pyramids on successive sheets and is the basic structure of the web of conventional honeycomb collimator. A plurality of such cells or building blocks may be formed and joined together to form a collimator of any size or dimension. In operation, the metallic vapor particles generated by the PVD equipment which are substantially perpendicular to the wafer pass directly through the cell 46 without contacting the interior surfaces 48, 50 thereof. Particles which are not substantially perpendicular to the wafer impact upon the interior surfaces 48, 50 of the cell and on leading edges 52, 54 of the sheets which form the cell.

Unfortunately, however, as the PVD process is performed, the cell opening is progressively occluded by the metallic material captured thereby. This significantly reduces the throughput of the PVD equipment. The leading edges, e.g. 52, 54, of the sheets which are substantially perpendicular to the general direction of flow of the metallic particles, as indicated by arrow 15 in FIG. 1, present flat surfaces upon which the depositing material accumulates. Depositing material adheres to these planar surfaces and builds up until it starts to grow beyond the boundaries of the sheet edges. As this happens, a "mushroom" shape is formed on the edges which grows toward the cell opening, reducing its size. This bulging mushroom shape prematurely renders the collimator ineffective.

In fact, prior art collimators typically last only half the life of the depositing material source. When the PVD machines are loaded with a collimator and source material billet, the operator must run through a long sequence of calibration procedures before producing wafers, resulting in significant production downtime. Ideally, to minimize downtime, the useful life of the collimator would coincide with that of the source material so that the collimator and source material could be replaced simultaneously.

Figure 3:
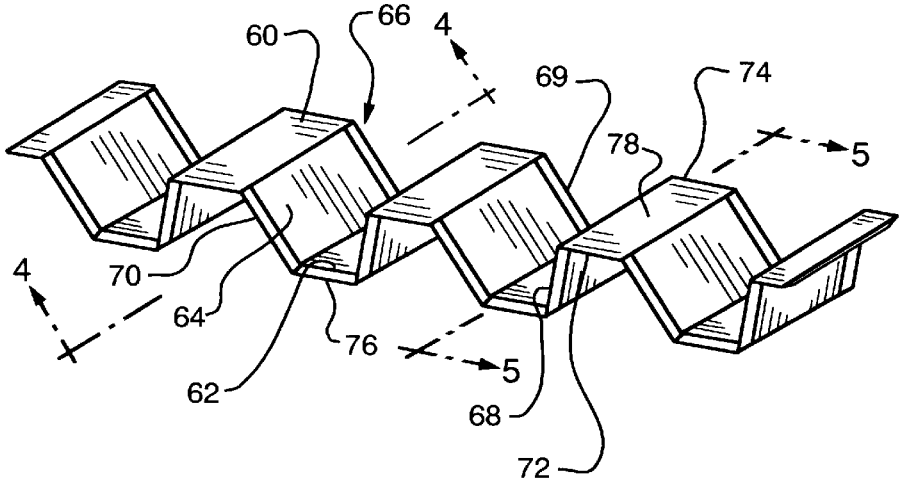
FIG. 3: is a perspective view of a deformed sheet useful in forming one embodiment of a collimator according to the present invention.
Figure 4:
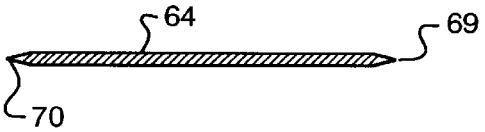
FIG. 4: is a sectional view of the sheet shown in FIG. 3 taken along lines IV—IV.
Figure 5:
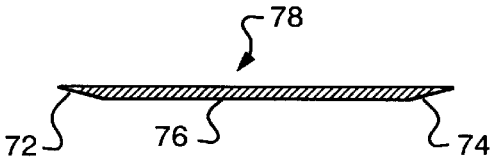
FIG. 5: is a sectional view of the sheet shown in FIG. 3 taken along lines V—V.

To accomplish this goal, the collimator according to the present invention is made from a plurality of deformed sheets as shown in FIGS. 3–5. As in the prior art, the sheets are preferably formed with top 60 and bottom 62 major flats connected by slant walls 64 to form repeating truncated pyramids alternately inverted. Each sheet 66, however, is formed with dual tapered edges, e.g. 68, 69, 70, on the slant walls and single tapered edges, e.g. 72, 74, 76, on the major flat portions.

The term "dual tapered edge", as used herein, means that the top and bottom surfaces of the sheet each taper toward each other to form a sharp or pointed edge, as shown in FIG. 4. The term "single tapered edge", as used herein, means that only one surface of the sheet tapers to form a pointed edge, as shown particularly in FIG. 5. Although the advantages of the present invention may be achieved by forming tapered edges on only the leading edge of the sheet, i.e. the edge closest to the source of metallic material, providing tapers on both edges of the sheets allows the collimator to be oriented with either edges as the leading edge. This eliminates any possible problems of the collimator being installed upside down.

Figure 6:
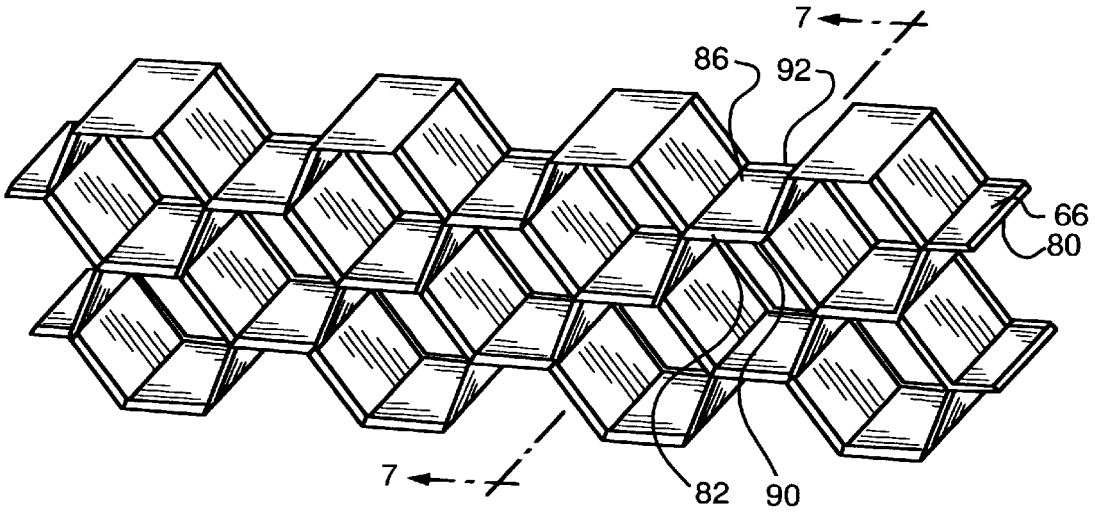
FIG. 6: is a perspective view of a portion of a collimator according to the present invention showing a plurality of deformed sheets joined together.
Figure 7:
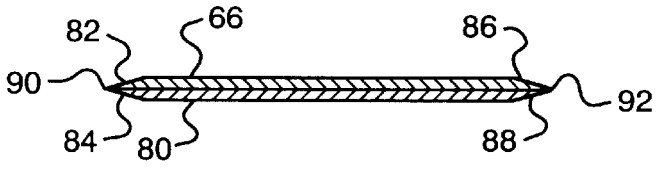
FIG. 7: is a sectional view of the collimator portion shown in FIG. 6 taken along lines VII—VII.

With reference to FIGS. 3 and 5, the single tapered edges on the major flat portions preferably taper toward the edge from the bottom surface 76 of the top flat portions 78, and from the top surface of the bottom flat portion 62. Thus, as shown in FIGS. 6 and 7, when sheets, e.g. 66, 80, are joined to form a collimator, opposing single tapers 82, 84, 86, 88 on the top and bottom major flat portions of successive sheets form dual tapered edges 90, 92. With this structure, all edges of the completed collimator are tapered to form a point.

Thus, the metallic particles which impact the tapered edges tend to build up laterally on the interior surface of the cells along the length of the tapers rather than in a mushroom-shape on a flat edge, as in the case of prior art collimator designs. Although accumulation of particles on the tapered edges eventually travels laterally into the cell opening, the rate at which the accumulation occurs is drastically reduced compared to prior art designs. Advantageously, therefore, the useful life of the collimator according to the present invention is significantly longer than the useful life of prior designs. This can directly translate to reduced PVD system downtime and a more efficient manufacturing process.

Figure 8:
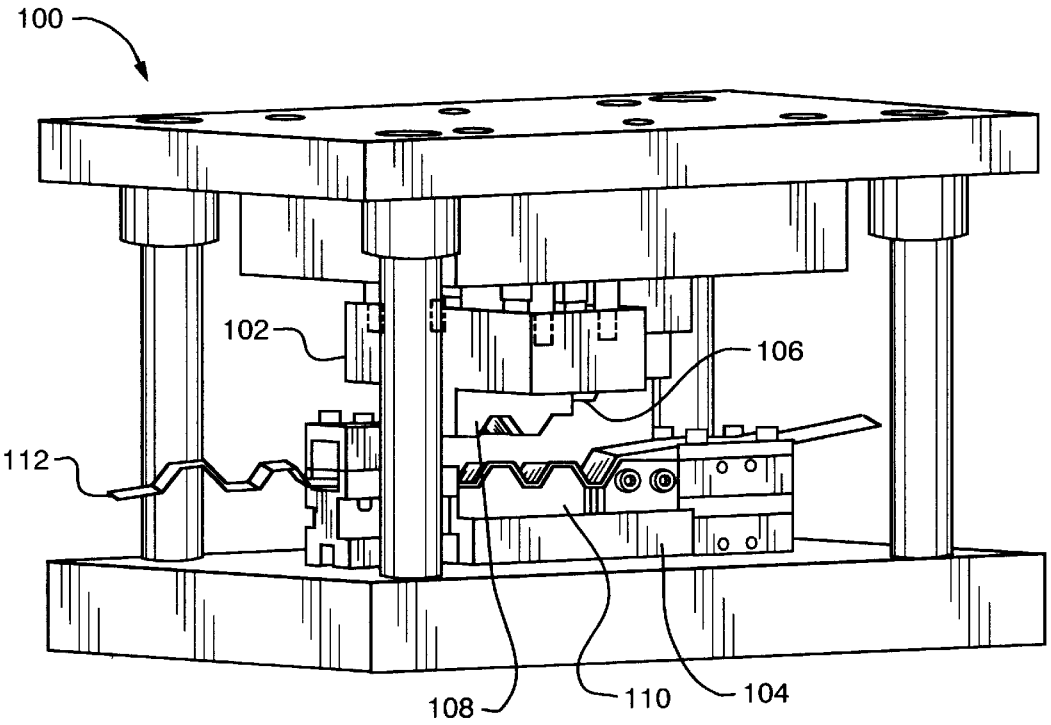
FIG. 8: is a perspective view of a progressive form die assembly by which the collimator of the present invention may be formed.

In FIG. 8, there may be seen one type of equipment, in the form of a progressive form die stamping machine 100, with which individual metallic sheets may be deformed according to the present invention. The progressive form die stamping machine includes a vertically reciprocating head 102 which cooperates with a fixed bed 104 to form a sheet 112 as the sheet is fed in a right-to-left direction between first 106 and second 108 punches and a die 110 section. Formation of the sheet is commenced by the deformation of the sheet into a first portion 114 of the die 110 by and end 116 of the first punch 106. This first step forms the general alternating truncated pyramid shape of the sheet 112.

Figure 9:
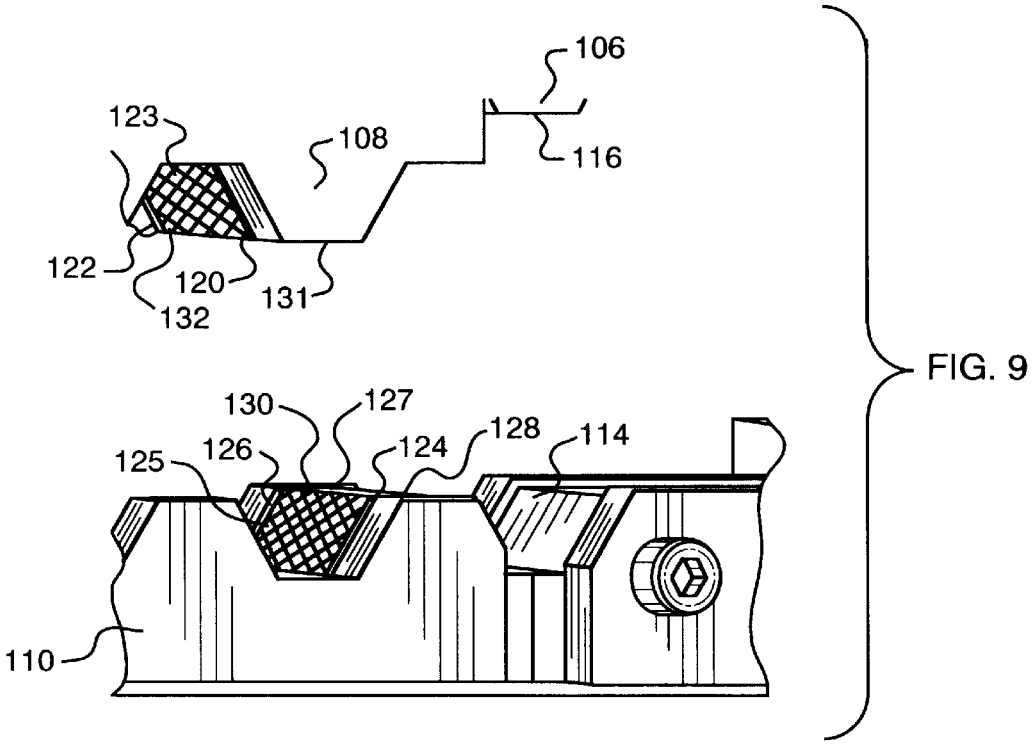
FIG. 9: is an enlarged view of punch and die sections of the die assembly shown in FIG. 8.

The second step in the formation of the sheet involves the formation of the dual tapered edges on the slant walls and the single tapered edges on the flat portions of the sheet. As shown particularly in FIG. 9, the second punch 108 is formed with tapered surfaces, e.g. 120, 122, in areas which contact the slant walls of the sheet. Corresponding tapered surfaces, e.g. 124, 126, are formed on the die portion 110 to form the dual tapered edges on the slant walls. To form the single tapered edges which taper from the bottom of the top flat portion, the die portion includes tapers 128, 130 on the top surfaces thereof which contact the top major flats. To form the single tapered edges which taper from the top of the bottom flat portion of the sheet, the second punch includes tapers, e.g. 132, on surfaces thereof which contact the top of the bottom major flats. Thus, the sheet is formed progressively over the die portion by the first and second punches.

Figure 10:
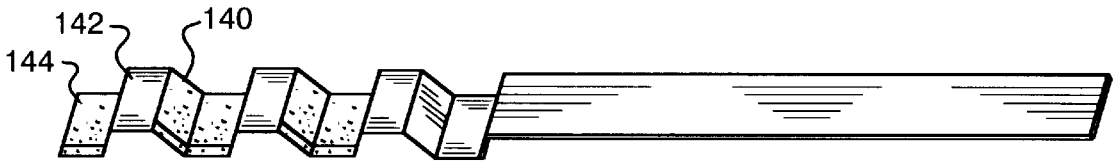
FIG. 10: is a perspective view of a deformed sheet having rough surfaces which is useful in forming another embodiment of a collimator according to the present invention.

In another embodiment, the punches and dies can be provided with rough surfaces which cause the direct formation of ridges or grooves on the surfaces of the sheet by swedging. As is known, the ridges/grooves formed on the interior cell surfaces improves the ability of the collimator to retain the particles which impact thereon. Thus, both the top and bottom of the slant surfaces, e.g. 140, may be provided with ridges/grooves, as shown in FIG. 10, by forming corresponding rough surfaces, e.g. 123, 125, on the second punch and the die. Ridges or grooves may also be formed on the bottom of the top flat portion 142 by forming a corresponding rough surface 127 on the top of the die, and on the top of the bottom flat portion 144 by forming a corresponding rough surface 131 on the second punch. To ensure that the successive sheets are properly joined, however, ridges/grooves are not formed on the areas of the top and bottom flat portions which are joined together, i.e. the top of the top flat portion and the bottom of the bottom flat portion. Compared to prior art methods wherein rough surfaces on the sheet are formed in an independent operation, the present method facilitates formation of roughened surfaces by swedging and the final shape of the sheet in the same manufacturing process, i.e. on the die stamping machine.

Thus, according to the present invention there is provided a collimator having tapered edges which increase the useful life of the collimator and, therefore, reduce downtime in the production of semiconductor wafers. The collimator is made from sheets of metallic material which are deformed using a progressive form die assembly into what may be termed truncated pyramids alternately inverted with top and bottom major flats connected by slant walls. Advantageously, the edges of the sheet are tapered to a point by the progressive form die assembly, which may also form roughened surfaces on the sheets by swedging. Edges of the slant walls which connect top and bottom major flats of the truncated pyramid shape are provided with a dual taper, and the edges of the major flats are provided with a single taper. When successive sheets are joined, the top and bottom major flats of successive sheets form a dual taper from the single tapers on the flats of each sheet. Thus, the completed collimator has leading edges which are all tapered to a point. As a result, the rate of growth of metallic particles beyond the borders of the collimator cell walls is decreased compared to prior art designs having flat edges.

The embodiments which have been described herein, however, are but some of the several which utilize this invention and are set forth here by way of illustration but not of limitation. For example, the sheets could be deformed into a variety of shapes with tapered edges thereon, and the collimator can be formed with any dimension and having any aspect ratio. It is obvious that many other embodiments, which will be readily apparent to those skilled the in art, may be made without departing materially from the spirit and scope of this invention.

What is claimed is:

1. A method of forming a collimator for filtering a flow of metallic particles generated by a device for depositing a film of metallic material on a semiconductor wafer, said collimator comprising a plurality of interconnected metal sheets, each of said sheets being formed in a repeating alternately inverted truncated pyramid shape having top and bottom major flats connected by slant walls, said sheets having single tapered edges on said top and bottom major flat portions and dual tapered edges formed on said slant walls, said single tapered edges on said top major flat portions being tapered from a bottom surface of said top major flat portions, and said single tapered edges on said bottom major flat portions being tapered from a top surface of said bottom major flat portions, whereby single tapered edges on top and bottom major flat portions of successive sheets, when joined together, form a dual tapered edge, said method comprising:

providing a progressive form die assembly having first and second reciprocating punches and a corresponding die, said first punch being dimensioned to cooperate with first areas of said die to form said alternately inverted truncated pyramid shape, said second punch and second areas of said die having corresponding tapers thereon for forming said dual tapered edges on said slant walls, said second punch being tapered to form said single tapered edges on said bottom flats, and said second areas of said die being tapered to form said single tapered edges on said top flats;

passing each of said sheets progressively between said first and second punches;

actuating said progressive form die assembly so that said first and second punches deform separate portions of each of said sheets into said die, said first punch cooperating with a first portion of said die to form said alternately inverted truncated pyramid shape, and said second punch cooperating with a second portion of said die to form said dual tapered edges on said slant walls and said single tapered edges on said top and bottom flats.

2. A method according to claim 1, wherein said die has rough surfaces formed thereon for forming grooves or ridges in said top and bottom flats and said slant walls by swedging when said sheet is deformed into said die by said first and second punches.

3. A method according to claim 1, wherein said second punch has rough surfaces formed thereon for forming grooves or ridges in said bottom flats and said slant walls by swedging when said sheet is deformed into said die by said first and second punches.

* * * * *